United States Patent [19]

Dunham et al.

[11] Patent Number: 4,708,673

[45] Date of Patent: Nov. 24, 1987

[54] OUTBOARD MOTOR COWL ASSEMBLY

[75] Inventors: William D. Dunham, Waukegan; John D. Flaig, Libertyville, both of Ill.; H. Norman Petersen; Robert F. Young, both of Kenosha, Wis.

[73] Assignee: Outboard Marine Corporation, Waukegan, Ill.

[21] Appl. No.: 4,756

[22] Filed: Jan. 8, 1987

Related U.S. Application Data

[63] Continuation of Ser. No. 752,144, Jul. 3, 1985, abandoned.

[51] Int. Cl.[4] ..... B63H 21/00

[52] U.S. Cl. ..... 440/77; 440/76; 123/195 C; 24/621

[58] Field of Search ..... 440/76, 77; 411/508; 24/297, 289, 621; 123/195 C, 195 D, 198 C

[56] References Cited

U.S. PATENT DOCUMENTS

| | | | |
|---|---|---|---|
| 2,256,831 | 9/1941 | Karey | 440/88 |
| 3,358,668 | 12/1967 | Post et al. | 440/77 |
| 3,773,010 | 8/1972 | Elingsen | 440/77 |
| 3,955,526 | 5/1976 | Kusche | 440/77 |
| 4,348,194 | 9/1982 | Walsh | 440/77 |
| 4,398,765 | 8/1983 | Ishikawa | 24/297 |
| 4,489,465 | 12/1984 | Lemkin | 24/297 |
| 4,524,494 | 6/1985 | Sato | 24/297 |

FOREIGN PATENT DOCUMENTS

| | | | |
|---|---|---|---|
| 5595457 | 2/1982 | Japan | 440/77 |
| 56203628 | 6/1983 | Japan | 440/77 |
| 59-156895 | 9/1984 | Japan | 440/77 |

*Primary Examiner*—Joseph F. Peters, Jr.
*Assistant Examiner*—Clifford T. Bartz
*Attorney, Agent, or Firm*—Michael, Best & Friedrich

[57] ABSTRACT

An outboard motor comprising a propulsion unit having opposite first and second sides and including a lower unit including a rotatably mounted propeller, and a drive shaft housing including a drive shaft drivingly connected to the propeller, and a power head mounted on the drive shaft housing and including an internal combustion engine drivingly connected to the drive shaft, a cowl assembly enclosing the power head and including a first lower cowl member removably and resiliently mounted on the first side of the propulsion unit, a second lower cowl member removably and resiliently mounted on the second side of the propulsion unit, and an upper cowl member removably mounted on the first and second lower cowl members, and a bolt detachably connecting the first lower cowl member to the second lower cowl member.

33 Claims, 8 Drawing Figures

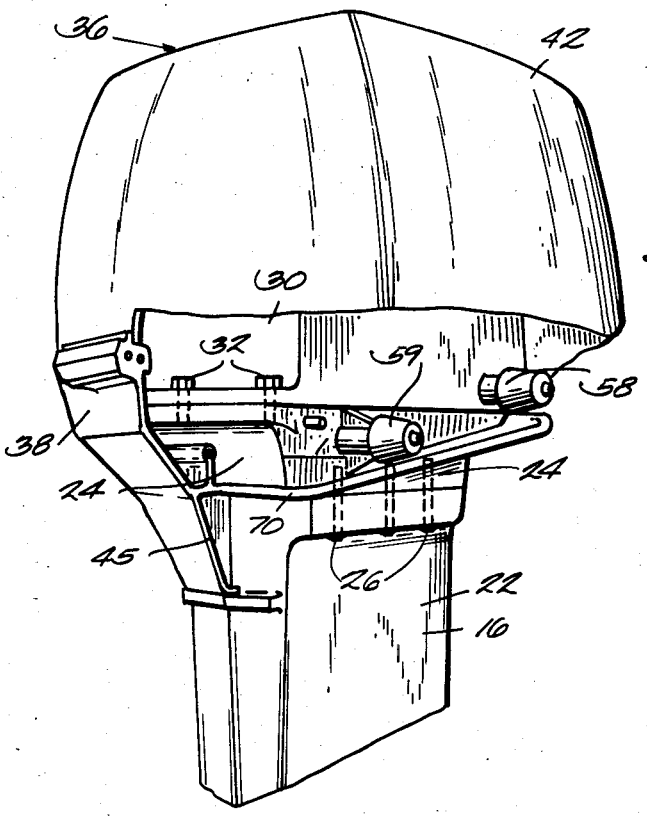
Fig. 3
Fig. 5
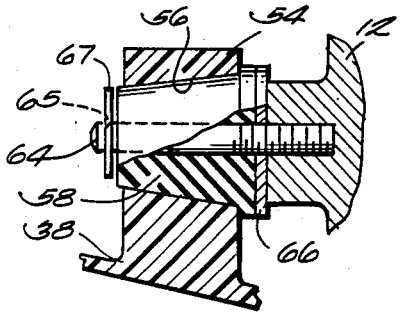
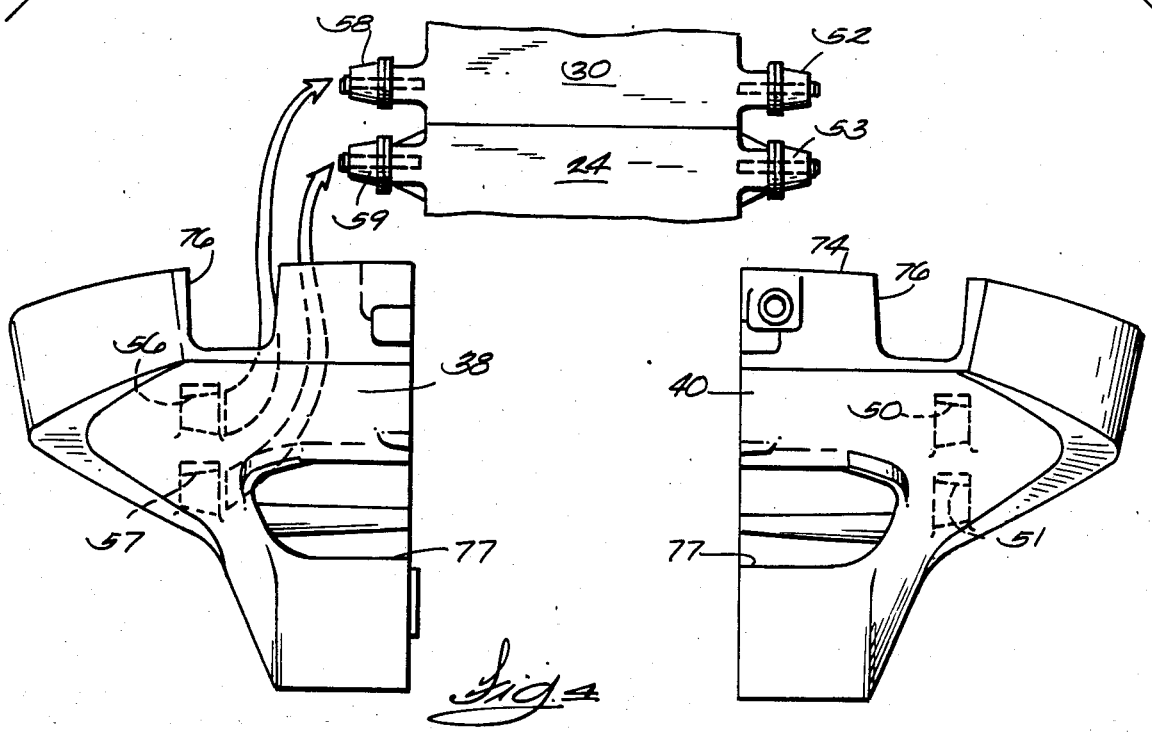
Fig. 4

83
80
84
78
74
47
46
76
44
38
82
45
40
71
48
50
77
60
62
54
56
79
49
51
55
57

OUTBOARD MOTOR COWL ASSEMBLY

This is a continuation of application Ser. No. 752,144, filed July 3, 1985, now abandoned.

BACKGROUND OF THE INVENTION

The invention relates to outboard motors, and more particularly to cowl assemblies enclosing the engines or power heads of outboard motors.

Various types of cowl assemblies for outboard motors are known in the art. Known cowl assemblies include the following: A two-piece assembly including a lower cover permanently attached to the propulsion unit, and an upper cover removably attached to the lower cover; a three-piece assembly including a removable two-piece lower cover, and an upper cover removably attached to the lower cover; a two-piece assembly including left and right side covers removably attached to the propulsion unit; and a three-piece assembly including a permanently attached lower cover, a permanently attached upper cover, and a removably attached "wrap around" intermediate cover.

Attention is directed to the following U.S. patents which disclose outboard motor cowling assemblies: Walsh U.S. Pat. No. 4,348,194, issued Sept. 7, 1982; Karey U.S. Pat. No. 2,256,831, issued Sept. 23, 1941; Post U.S. Pat. No. 3,358,668, issued Dec. 19, 1967; Elingsen U.S. Pat. No. 3,773,010, issued Nov. 20, 1973; and Kusche U.S. Pat. No. 3,955,526 issued May 11, 1976.

Attention is also directed to Ferguson U.S. patent application Ser. No. 593,285, filed Mar. 26, 1984, now abandoned.

SUMMARY OF THE INVENTION

The invention provides an outboard motor comprising a propulsion unit having opposite first and second sides and including a drive shaft housing including a rotatably mounted propeller, and a drive shaft drivingly connected to the propeller, and a power head mounted on the drive shaft housing and including an internal combustion engine drivingly connected to the drive shaft, a cowl assembly enclosing the power head and including a first cowl member, and a second cowl member, means for detachably connecting the first cowl member to the second cowl member, first means for removably and resiliently mounting the first cowl member on the first side of the propulsion unit, and second means for removably and resiliently mounting the second cowl member on the second side of the propulsion unit.

The invention also provides an outboard motor comprising a propulsion unit having opposite first and second sides and including a drive shaft housing including a rotatably mounted propeller, and a drive shaft drivingly connected to the propeller, and a power head mounted on the drive shaft housing and including an internal combustion engine drivingly connected to the drive shaft, a cowl assembly enclosing the power head and including a first lower cowl member, a second lower cowl member, and an upper cowl member removably mounted on the first and second lower cowl members, means for detachably connecting the first lower cowl member to the second lower cowl member, first means for removably and resiliently mounting the first lower cowl member on the first side of the propulsion unit, and second means for removably and resiliently mounting the second lower cowl member on the second side of the propulsion unit.

In one embodiment, the power head has opposite first and second sides, the first means includes means removably and resiliently mounting the first lower cowl member on the first side of the power head, and the second means includes means removably and resiliently mounting the second lower cowl member on the second side of the power head.

In one embodiment, the drive shaft housing has opposite first and second sides, the first means includes means removably and resiliently mounting the first lower cowl member on the first side of the drive shaft housing, and the second means includes means removably and resiliently mounting the second lower cowl member on the second side of the drive shaft housing.

In one embodiment, the first means includes a first recess in one of the first lower cowl member and the propulsion unit, and a resilient mounting member connected to the other of the first lower cowl member and the propulsion unit and removably received in the first recess, and the second means includes a second recess in one of the second lower cowl member and the propulsion unit, and a resilient mounting member connected to the other of the second lower cowl member and the propulsion unit and removably received in the second recess.

In one embodiment, the means connecting the first lower cowl member to the second lower cowl member includes means for compressing the first resilient mounting member between the first lower cowl member and the propulsion unit and for compressing the second resilient mounting member between the second lower cowl member and the propulsion unit.

In one embodiment, the first recess is in the first lower cowl member, the first resilient mounting member is connected to the first side of the propulsion unit, the second recess is in the second lower cowl member, and the second resilient mounting member is connected to the second side of the propulsion unit.

In one embodiment, the first means further includes a first mounting pin extending generally horizontally from the first side of the propulsion unit, the first resilient mounting member is mounted on the first mounting pin, the second means further includes a second mounting pin extending generally horizontally from the second side of the propulsion unit, and the second resilient mounting member is mounted on the second mounting pin.

In one embodiment, the first resilient mounting member is frustoconical, and the second resilient mounting member is frustoconical.

In one embodiment, the upper cowl member has a lower edge portion, the first lower cowl member has an upper edge portion and has therein a slot extending downwardly from the upper edge portion, and the outboard motor further comprises a grommet removably received in the slot, and means for detachably connecting the upper cowl member to the first lower cowl member with the lower edge portion of the upper cowl member mating with the upper edge portion of the first lower cowl member and trapping the grommet in the slot.

The invention also provides an outboard motor comprising a propulsion unit including a drive shaft housing including a rotatably mounted propeller, and a drive shaft drivingly connected to the propeller, and a power head mounted on the drive shaft housing and including an internal combustion engine drivingly connected to the drive shaft, a cowl assembly enclosing the power head and including a first cowl member having a first edge portion, and a second cowl member having a second edge portion and having therein a slot extending from the second edge portion, a grommet removably received in the slot, and means for detachably connecting the first cowl member to the second cowl member with the edge portion of the first cowl member mating with the edge portion of the second cowl member and trapping the grommet in the slot.

A principal feature of the invention is the above described cowl assembly and mounting means. These provide easy installation and removal of the covers, improved vibration and noise isolation, and improved sealing of the power head.

Another principle feature of the invention is the above described grommet arrangement for connecting an exterior device such as a fuel tank or a remote control system to the engine. This arrangement eliminates the need to disconnect the fuel system or remote control system when removing the motor covers.

Another principal feature of the invention is the means for mounting the cowl members on the sides of the propulsion unit. This is advantageous because large outboard motors are commonly lifted by fork lifts with the forks being positioned beneath the lower cowl members and extending in the fore and aft direction on either side of the propulsion unit. On outboard motors having the lower cowl members connected to the drive shaft housing beneath the power head or engine, such lifting can cause substantial stress on the lower cowl members since the forks are usually positioned outside of the power head, some distance from the point at which the lower cowl members are connected to the drive shaft housing or propulsion unit. This problem is substantially avoided by the present invention since the lower cowl members are mounted on the sides of the propulsion unit, and more particularly on the sides of the drive shaft housing and the power head. Thus, the forks of a fork lift will be positioned almost directly beneath the points at which the lower cowl members are connected to the propulsion unit, so that the lifting forces are transferred almost directly to the propulsion unit, with little stress being placed on the lower cowl members.

Other features and advantages of the invention will become apparent to those skilled in the art on review of the following detailed description, claims, and drawings.

DESCRIPTION OF THE DRAWINGS

FIG. 3 is a partial perspective view of the outboard motor with the upper cowl member and right lower cowl member removed.

FIG. 4 is an exploded front view of the lower motor covers.

FIG. 5 is an enlarged view, partially in cross section, of the means for mounting the lower motor covers on the propulsion unit.

Figure 1:
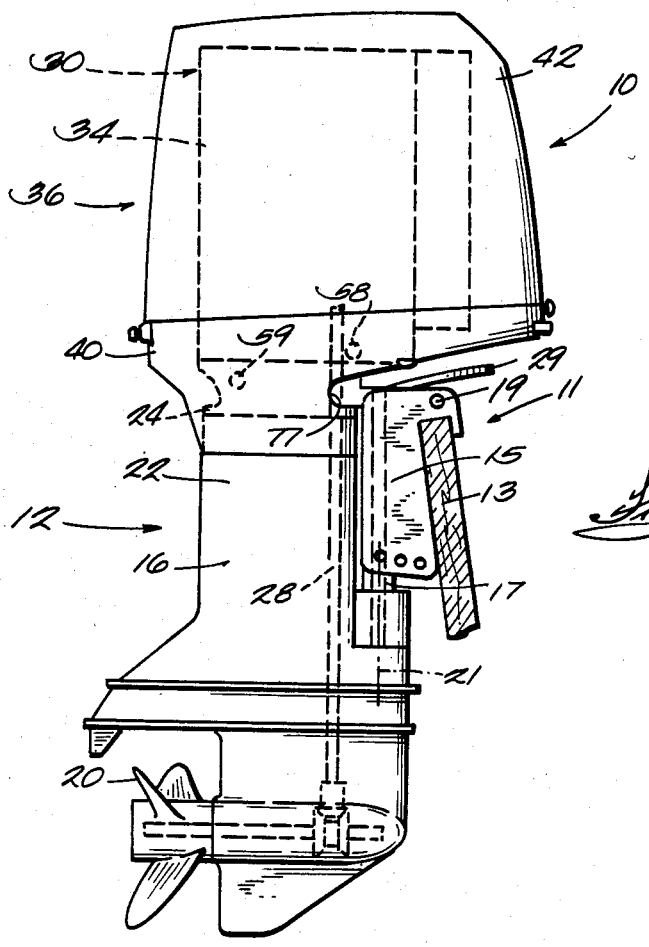
FIG. 1 is a side elevational view of an outboard motor embodying the invention.
Figure 2:
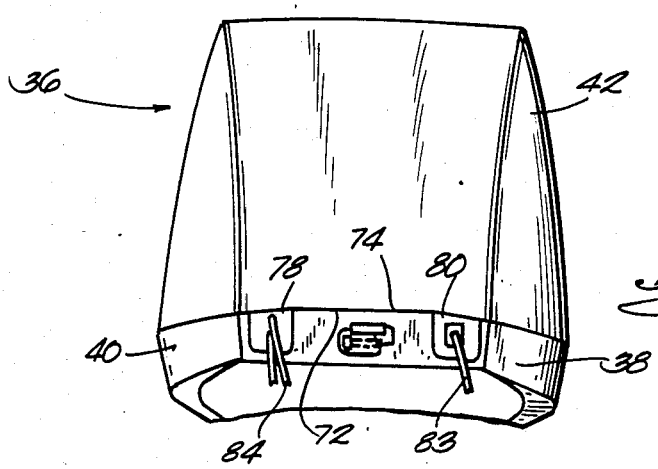
FIG. 2 is a partial front view of the outboard motor.
Figure 6:
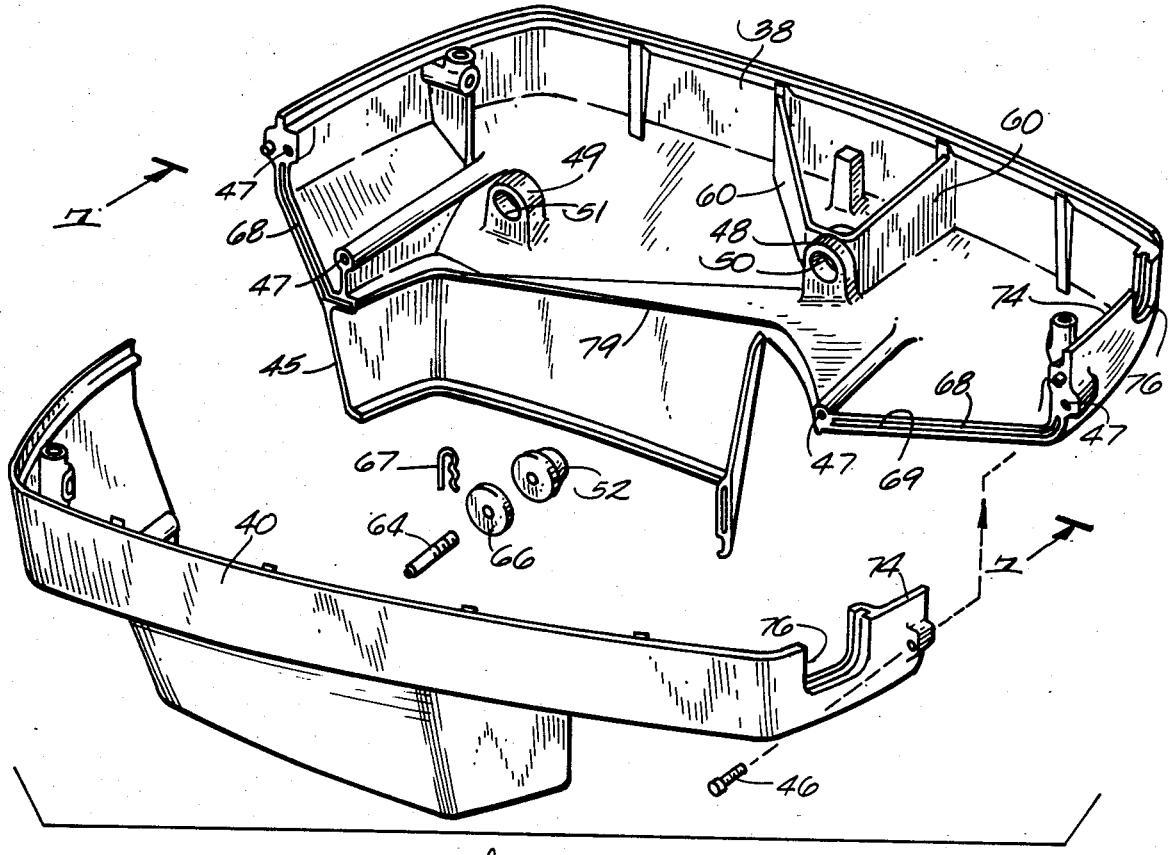
FIG. 6 is an exploded perspective view of the lower motor covers.
Figure 7:
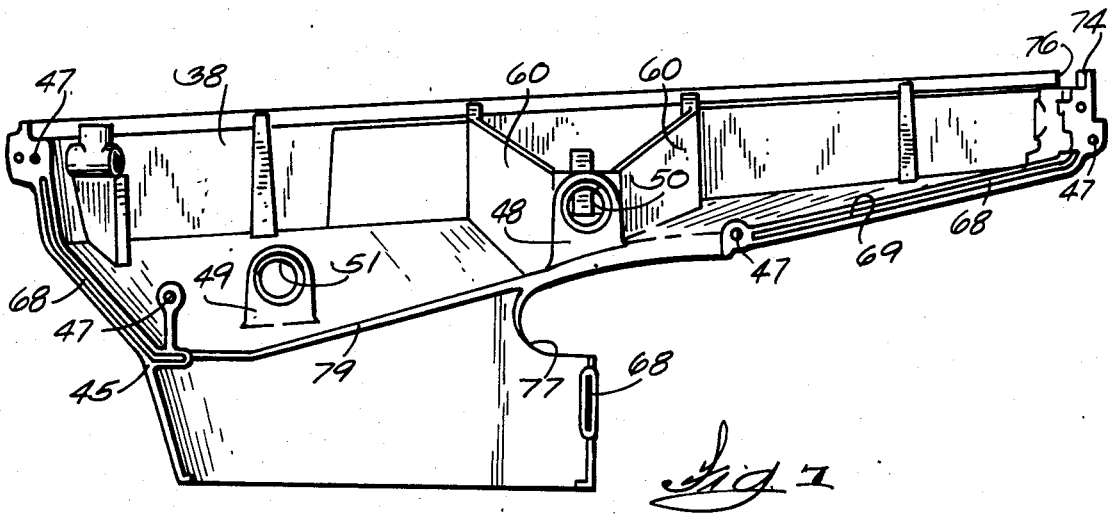
FIG. 7 is a cross sectional view taken along line 7—7 in FIG. 6.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

An outboard motor 10 embodying the invention is illustrated in the drawings. As best shown in FIG. 1, the outboard motor 10 comprises a mounting assembly 11 fixedly attached to the transom 13 of a boat. The mounting assembly includes a transom bracket 15 fixedly attached to the transom 13, and a swivel bracket 17 pivotally mounted on the transom bracket 15 for pivotal movement of the swivel bracket 17 relative to the transom bracket 15 about a generally horizontal tilt axis 19.

The outboard motor 10 also comprises a propulsion unit 12 pivotally mounted on the swivel bracket 17 for pivotal steering movement of the propulsion unit 12 relative to the swivel bracket 17 and to the transom 13 about a generally vertical steering axis 21, and for common tilting movement of the propulsion unit 12 and the swivel bracket 17 about the tilt axis 19.

The propulsion unit 12 has opposite first and second or left and right sides and includes, in the preferred embodiment, a drive shaft housing 16, and a rotatably mounted propeller 20. Preferably, the drive shaft housing 16 includes a main body 22, an adaptor unit 24 mounted on the main body 22 by a plurality of bolts 26, and a drive shaft 28 drivingly connected to the propeller 20. The propulsion unit also includes a steering arm assembly 29 fixedly attached to the drive shaft housing 16 for effecting pivotal steering movement of the propulsion unit 12. The propulsion unit 12 further includes a power head 30 mounted on the drive shaft housing 16 and including an internal combustion engine 34 drivingly connected to the drive shaft 28. In the preferred embodiment, the power head 30 is mounted on the adaptor unit 24 by a plurality of bolts 32. The drive shaft housing 16 and the power head 30 also have opposite first and second or left and right sides.

The outboard motor 10 also comprises a cowl assembly 36 enclosing the power head 30, and, in the preferred embodiment, tne adaptor unit 24 and the upper end of the main body 22 of the drive shaft housing 16. In the preferred embodiment, the cowl assembly 36 includes a first or left lower cowl member 38, a second or right lower cowl member 40, and an upper cowl member 42 removably mounted on the left and right lower cowl members 38 and 40. In the preferred embodiment, the upper cowl member 42 is detachably connected to the lower cowl members 38 and 40 by a plurality of latch assemblies 44. It should be understood that in alternative embodiments the cowl assembly 36 can include only first and second or left and right side cowl members with each side cowl member including a lower cowl portion similar in construction to the lower cowl members 38 and 40.

Each of the lower cowl members 38 and 40 includes an inner edge 45 which mates with the inner edge 45 of the other of the lower cowl members 38 and 40. Also, each of the lower cowl members 38 and 40 includes a recess or opening 77 which extends from the inner edge 45 and which combines with a symmetrical recess 77 in the other of the lower cowl members 38 and 40 to form an opening allowing the steering arm assembly 29 to extend through the cowl assembly 36, as best shown in FIG. 1.

Figure 8:
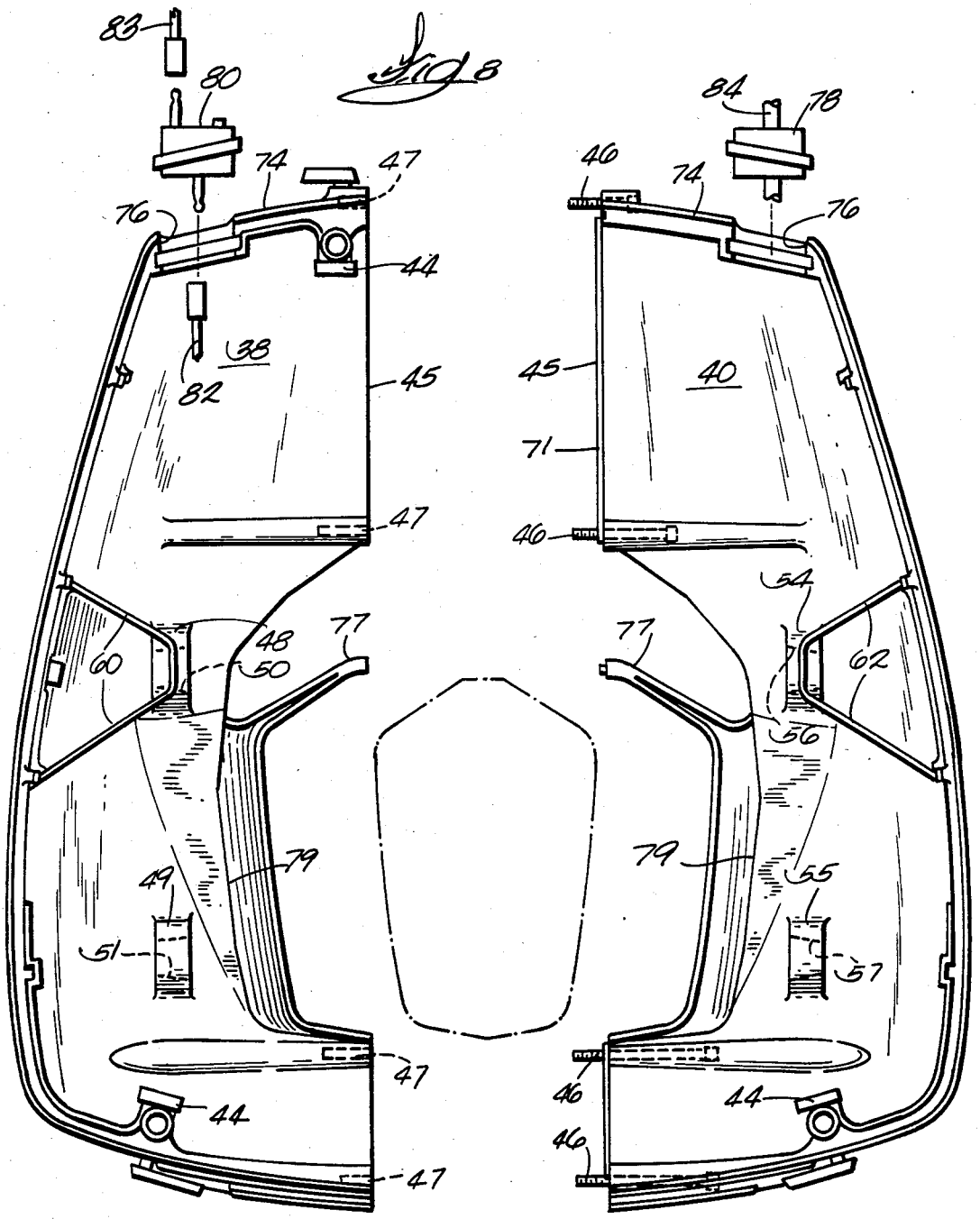
FIG. 8 is an exploded top view of the lower motor covers.

The outboard motor 10 also comprises means for detachably connecting the left lower cowl member 38 to the right lower cowl member 40. While various suitable connecting means can be used, in the preferred embodiment, the connecting means includes (see FIG. 8) a plurality of bolts 46 received in apertures 47.

The outboard motor 10 further comprises first means for removably and resiliently mounting the left lower cowl member 38 on the left side of the propulsion unit 12, and second means for removably and resiliently mounting the right lower cowl member 40 on the right side of the propulsion unit 12. More particularly, in the preferred embodiment, the first means includes means removably and resiliently mounting the left lower cowl member 38 on the left side of the power head 30, and means removably and resiliently mounting the left lower cowl member 38 on the left side of the drive shaft housing 16, and the second means includes means removably and resiliently mounting the right lower cowl member 40 on the right side of the power head 30, and means removably and resiliently mounting the right lower cowl member 40 on the right side of the drive shaft housing 16.

While various suitable removable and resilient mounting means can be employed, in the preferred embodiment, the left lower cowl member 38 includes upwardly extending projections 48 and 49 respectively defining first recesses or apertures 50 and 51, and the first means includes the recesses 50 and 51, and a pair of resilient mounting members 52 and 53 connected to the left side of the propulsion unit 12 and respectively removably received in the first recesses 50 and 51. The right lower cowl member 40 includes upwardly extending projections 54 and 55 respectively defining second recesses or apertures 56 and 57, and the second means includes the recesses 56 and 57, and a pair of resilient mounting members 58 and 59 connected to the right side of the propulsion unit 12 and respectively removably received in the second recesses 56 and 57.

Preferably, the projection 48 is supported by rigidifying members 60, and the projection 54 is supported by rigidifying members 62. Furthermore, the recesses 50, 51, 56 and 57 are preferably tapered, and more particularly frustoconical. In the preferred embodiment, as best shown in FIGS. 3 and 4, the resilient mounting members 52 and 58 are connected to the opposite sides of the power head 30, and the resilient mounting members 53 and 59 are connected to the opposite sides of the adaptor unit 24.

In the preferred embodiment, as best shown in FIG. 5, each of the mounting means includes a mounting pin 64 extending generally horizontally from the propulsion unit 12 (i.e., from either the power head 30 or the adaptor unit 24), with one of the resilient mounting members 52, 53, 58 and 59 mounted on each of the mounting pins 64. In the preferred embodiment, each of the mounting pins 64 has an annular groove 65 around its outer end, and a clip 67 can be fastened in the groove 65 to secure the respective mounting member 52, 53, 58 or 59 to the mounting pin 64. Preferably, each of the mounting members 52, 53, 58 and 59 is tapered so that each member becomes wedged in its respective recess or aperture when the lower cowl members 38 and 40 are connected to the propulsion unit 12. More particularly, each of the mounting members 52, 53, 58 and 59 has a generally frustoconical shape complementary with the shape of the recesses or apertures 50, 51, 56 and 57. In the illustrated construction, each of the mounting means also includes a washer 66 located between the mounting member 52, 53, 58 or 59 and the side of the propulsion unit 12. As best shown in FIG. 5, when the mounting member 52, 53, 58 or 59 is properly located in its respective aperture 50, 51, 56 or 57, the respective lower cowl member 38 or 40 is isolated from the propulsion unit 12 by the resilient mounting member.

In order to reduce vibration of the cowl assembly 36, the means connecting the lower cowl members 38 and 40 includes means for compressing the mounting members 52, 53, 58 and 59 between the lower cowl members 38 and 40 and the propulsion unit 12. While various suitable compressing means can be employed, in the preferred construction, the compressing means includes the bolts 46. Thus, as the bolts 46 are tightened to connect the lower cowl members 38 and 40, the mounting members 52, 53, 58 and 59 are compressed between the lower cowl members and the propulsion unit 12.

In the preferred embodiment, the cowl assembly 36 includes resilient seals 68 along the split line between the left and right lower covers 38 and 40, and a resilient seal 70 around the adaptor unit 24 for sealing the lower cowl members 38 and 40 to the adaptor unit 24. In the illustrated construction, the seals 68 are located within grooves 69 in the inner edge 45 of the left lower cowl member 38, and the inner edge 45 of the right lower cowl member 40 includes tongue portions 71 receivable in the grooves 69. Also, each of the lower cowl members 38 and 40 includes an inwardly extending flange 79 which abuts the seal 70 when the lower cowl members 38 and 40 are mounted on the propulsion unit 12. The seals 68 and 70 are compressed when the lower cowl members 38 and 40 are connected. The seals 68 and 70 provide substantially total sealing of the lower cowl members 38 and 40 to the propulsion unit 12.

Preferably, the upper cowl member 42 has a lower edge portion 72, and each of the lower cowl members 38 and 40 has a forward upper edge portion 74 having therein a downwardly extending slot 76. The outboard motor further comprises a grommet 78 removably received in the slot 76 in the right lower cowl member 40, a grommet 80 removably received in the slot 76 in the left lower cowl member 38, and means detachably connecting the upper cowl member 42 to the lower cowl members 38 and 40 with the lower edge portion 72 of the upper cowl member 42 mating with the upper edge portions 74 of the lower cowl members 38 and 40 and trapping the grommets 78 and 80 in the slots 76. While various suitable connecting means can be used, in the preferred embodiment, the connecting means includes the latches 44.

The grommets 78 and 80 are adapted to receive or be connected to control or supply lines connected between engine 34 and a device located exteriorly of the cowl assembly 36. In the preferred embodiment, the grommet 80 is removably connected to a fuel line 82 which communicates with the engine 34, and to a fuel line 83 which communicates with a remote source of fuel (not shown), and the grommet 78 receives shift and throttle control cables 84 connected between tne engine 34 and a remote control apparatus (not shown) such as a single lever control.

When the cowl assembly 36 is removed from the propulsion unit 12, the grommets 78 and 80 are removed from their respective slots 76 and the fuel line 82 and the shift and throttle cables 84 remain connected to the engine 34.

Various features and advantages of the invention are set forth in the following claims.

We claim:

1. An outboard motor comprising a propulsion unit having a front, opposite first and second sides having respective surfaces and including a drive shaft housing including a rotatably mounted propeller, and a drive shaft drivingly connected to said propeller, and a power head mounted on said drive shaft housing and including an internal combustion engine drivingly connected to said drive shaft, a cowl assembly enclosing said power head and including a first cowl member, and a second cowl member, first means for removably and resiliently mounting said first cowl member on said first side of said propulsion unit and including a first aperature having a generally horizontal axis and supported on one of said first cowl member and said first side surface of said propulsion unit rearwardly of said front, and a first resilient mounting member supported on the other of said first cowl member and said first side surface of said propulsion unit rearwardly of said front and received in said first aperature, second means for removably and resiliently mounting said second cowl member on said second side of said propulsion unit and including a second aperture having a generally horizontal axis and supported on one of said second cowl member and said second side surface of said propulsion unit rearwardly of said front, and a second resilient mounting member supported on the other of said second cowl member and said second side surface of said propulsion unit rearwardly of said front and received in said second aperature, and means for releasably connecting together said first and second cowl members to retain said first and second mounting members in said first and second aperatures.

2. An outboard motor as set forth in claim 1 wherein said power head has opposite first and second sides, wherein said first means includes means removably and resiliently mounting said first cowl member on said first side of said power head, and wherein said second means includes means removably and resiliently mounting said second cowl member on said second side of said power head.

3. An outboard motor as set forth in claim 1 wherein said drive shaft housing has opposite first and second sides, wherein said first means includes means removably and resiliently mounting said first cowl member on said first side of said drive shaft housing, and wherein said second means includes means removably and resiliently mounting said second cowl member on said second side of said drive shaft housing.

4. An outboard motor as set forth in claim 3 wherein said power head has opposite first and second sides, wherein said first means also includes means removably and resiliently mounting said first cowl member on said first side of said power head, and wherein said second means also includes means removably and resiliently mounting said second cowl member on said second side of said power head.

5. An outboard motor as set forth in claim 1 wherein said first aperature is in said first cowl member, wherein said first resilient mounting member is supported on said first side of said propulsion unit, wherein said second aperature is in said second cowl member, and wherein said second resilient mounting member is supported on said second side of said propulsion unit.

6. An outboard motor as set forth in claim 5 wherein said first means further includes a first mounting pin extending generally horizontally from said first side of said propulsion unit, wherein said first resilient mounting member is mounted on said first mounting pin, wherein said second means further includes a second mounting pin extending generally horizontally from said second side of said propulsion unit, and wherein said second resilient mounting member is mounted on said second mounting pin.

7. An outboard motor as set forth in claim 6 wherein said first and second resilient mounting members and said first and second aperatures are frustoconical.

8. An outboard motor comprising a propulsion unit having a front, opposite first and second sides having respective surfaces and including a drive shaft housing including a rotatably mounted propeller, and a drive shaft drivingly connected to said propeller, and a power head mounted on said drive shaft housing and including an internal combustion engine drivingly connected to said drive shaft, a cowl assembly enclosing said power head and including a first lower cowl member, a second lower cowl member, and an upper cowl member, first means for removably and resiliently mounting said first lower cowl member on said first side of said propulsion unit and including a first aperture having a generally horizontal axis and supported on one of said first cowl member and said first side surface of said propulsion unit rearwardly of said front, and a first resilient mounting member supported on the other of said first cowl member and said first side surface of said propulsion unit rearwardly of said front and received in said first aperature, second means for removably and resiliently mounting said second cowl member on said second side of said propulsion unit and including a second aperature having a generally horizontal axis and supported on one of said second cowl member and said second side surface of said propulsion unit rearwardly of said front, and a second resilient mounting member supported on the other of said second cowl member and said second side surface of said propulsion unit rearwardly of said front and received in said second aperature, means for releasably connecting together said first and second cowl members to retain said first and second mounting members in said first and second aperatures, and means removably mounting said upper cowl member on said lower cowl members.

9. An outboard motor as set forth in claim 8 wherein said power head has opposite first and second sides, wherein said first means includes means removably and resiliently mounting said first lower cowl member on said first side of said power head, and wherein said second means includes means removably and resiliently mounting said second lower cowl member on said second side of said power head.

10. An outboard motor as set forth in claim 8 wherein said drive shaft housing has opposite first and second sides, wherein said first means includes means removably and resiliently mounting said first lower cowl member on said first side of said drive shaft housing, and wherein said second means includes means removably and resiliently mounting said second lower cowl member on said second side of said drive shaft housing.

11. An outboard motor as set forth in claim 10 wherein said power head has opposite first and second sides, wherein said first means also includes means removably and resiliently mounting said first lower cowl member on said first side of said power head, and wherein said second means also includes means removably and resiliently mounting said second lower cowl member on said second side of said power head.

12. An outboard motor as set forth in claim 8 wherein said first aperature is in said first lower cowl member, wherein said first resilient mounting member is supported on said first side of said propulsion unit, wherein said second aperature is in said second lower cowl member, and wherein said second resilient mounting member is supported on said second side of said propulsion unit.

13. An outboard motor as set forth in claim 12 wherein said first means further includes a first mounting pin extending generally horizontally from said first side of said propulsion unit, wherein said first resilient mounting member is mounted on said first mounting pin, wherein said second means further includes a second mounting pin extending generally horizontally from said second side of said propulsion unit, and wherein said second resilient mounting member is mounted on said second mounting pin.

14. An outboard motor as set forth in claim 13 wherein said first and second resilient mounting members and said first and second aperatures are frustoconical.

15. An outboard motor comprising a propulsion unit having opposite first and second sides and including a drive shaft housing including a rotatably mounted propeller, and a drive shaft drivingly connected to said propeller, and a power head mounted on said drive shaft housing and including an internal combustion engine drivingly connected to said drive shaft, a cowl assembly enclosing said power head and including a first lower cowl member, a second lower cowl member, and an upper cowl member, first means for removably and resiliently mounting said first lower cowl member on said first side of said propulsion unit and including a first aperature having a generally horizontal axis and supported on one of said first cowl member and said first side of said propulsion unit, and a first resilient mounting member supported on the other of said first cowl member and said first side of said propulsion unit and received in said first aperature, second means for removably and resiliently mounting said second cowl member on said second side of said propulsion unit and including a second aperature having a generally horizontal axis and supported on one of said second cowl member and said second side of said propulsion unit, and a second resilient mounting member supported on the other of said second cowl member and said second side of said propulsion unit and received in said second aperature, said first and second means for mounting said cowl members including means for compressing said first resilient mounting member in said first aperature incident to receipt of said first mounting member in said first aperature and for compressing said second resilient mounting member in said second aperature incident to receipt of said second mounting member in said second aperture, means for releasably connecting together said first and second cowl members to retain said first and second mounting members in said first and second aperatures and to compress said first and second mounting members in said first and second apertures, and means removably mounting said upper cowl member on said lower cowl members.

16. An outboard motor as set forth in claim 15 wherein said power head has opposite first and second sides, wherein said first means includes means removably and resiliently mounting said first lower cowl member on said first side of said power head, and wherein said second means includes means removably and resiliently mounting said second lower cowl member on said second side of said power head.

17. An outboard motor as set forth in claim 15 wherein said drive shaft housing has opposite first and second sides, wherein said first means includes means removably and resiliently mounting said first lower cowl member on said first side of said drive shaft housing, and wherein said second means includes means removably and resiliently mounting said second lower cowl member on said second side of said drive shaft housing.

18. An outboard motor as set forth in claim 17 wherein said power head has opposite first and second sides, wherein said first means also includes means removably and resiliently mounting said first lower cowl member on said first side of said power head, and wherein said second means also includes means removably and resiliently mounting said second lower cowl member on said second side of said power head.

19. An outboard motor as set forth in claim 15 wherein said first aperature is in said first lower cowl member, wherein said first resilient mounting member is supported on said first side of said propulsion unit, wherein said second aperature is in said second lower cowl member, and wherein said second resilient mounting member is supported on said second side of said propulsion unit.

20. An outboard motor as set forth in claim 19 wherein said first means further includes a first mounting pin extending generally horizontally from said first side of said propulsion unit, wherein said first resilient mounting member is mounted on said first mounting pin, wherein said second means further includes a second mounting pin extending generally horizontally from said second side of said propulsion unit, and wherein said second resilient mounting member is mounted on said second mounting pin.

21. An outboard motor as set forth in claim 20 wherein said first and second resilient mounting members and said first and second aperatures are frustoconical.

22. An outboard motor comprising a propulsion unit having opposite first and second sides and including a drive shaft housing including a rotatably mounted propeller, and a drive shaft drivingly connected to said propeller, and a power head mounted on said drive shaft housing and including an internal combustion engine drivingly connected to said drive shaft, a cowl assembly enclosing said power head and including a first lower cowl member, a second lower cowl member, and an upper cowl member removably mounted on said first and second lower cowl members, and including a lower edge first means for removably and resiliently mounting said first lower cowl member on said first side of said propulsion unit, second means for removably and resiliently mounting said second lower cowl member on said second side of said propulsion unit, one of said cowl members including an edge portion having therein a slot extending away from another of said cowl members, a grommet removably received in said slot, means for detachably connecting said first lower cowl member to said second lower cowl member, and means for detachably connecting said upper cowl member to said lower cowl members with said upper cowl member mating with said lower cowl members and with said lower edge engaging said grommet to trap said grommet in said slot.

23. An outboard motor comprising a propulsion unit including a drive shaft housing including a rotatably mounted propeller, and a drive shaft drivingly connected to said propeller, and a power head mounted on said drive shaft housing and including an internal combustion engine drivingly connected to said drive shaft, a cowl assembly enclosing said power head and including a first cowl member having an edge portion, and a second cowl member having an edge portion and having therein a slot extending from said edge portion, a grommet removably received in said slot and having therein a supply or control line extending between the interior of said cowl assembly and the exterior thereof, and means for detachably connecting said first cowl member to said second cowl member with said edge portion of said first cowl member mating with said edge portion of said second cowl member and with said first cowl member engaging said grommet to trap said grommet in said slot.

24. An outboard motor comprising a propulsion unit having opposite first and second sides and including a drive shaft housing including a rotatably mounted propeller, and a drive shaft drivingly connected to said propeller, and a power head mounted on said drive shaft housing and including an internal combustion engine drivingly connected to said drive shaft, a first lower cowl member having an upper edge portion and having therein a slot extending downwardly from said upper edge portion, a first recess in said first lower cowl member, a resilient mounting member connected to said first side of said propulsion unit and removably received in said first recess, a second lower cowl member, a second recess in said second lower cowl member, a resilient mounting member connected to said second side of said propulsion unit and removably received in said second recess, means for detachably connecting said first lower cowl member to said second lower cowl member and including means for compressing said first resilient mounting member between said first lower cowl member and said propulsion unit, and for compressing said second resilient mounting member between said second lower cowl member and said propulsion unit, an upper cowl member having a lower edge portion, a grommet removably received in said slot, and means for detachably connecting said upper cowl member to said first and second lower cowl members with said lower edge portion of said upper cowl member mating with said upper edge portion of said first lower cowl member and trapping said grommet in said slot.

25. An outboard motor as set forth in claim 24 further comprising a first mounting pin extending generally horizontally from said first side of said propulsion unit, and a second mounting pin extending generally horizontally from said second side of said propulsion unit, wherein said first resilient mounting member is mounted on said first mounting pin, and wherein said second resilient mounting member is mounted on said second mounting pin.

26. An outboard motor as set forth in claim 25 said first resilient mounting member is frustoconical, and wherein said second resilient mounting member is frustoconical.

27. An outboard motor comprising a propulsion unit having opposite first and second sides and including a drive shaft housing including a rotatably mounted propeller, and a drive shaft drivingly connected to said propeller, and a power head mounted on said drive shaft housing and including an internal combustion engine drivingly connected to said drive shaft, a cowl assembly enclosing said power head and including a first cowl member, and a second cowl member, first means for removably and resiliently mounting said first cowl member on said first side of said propulsion unit and including a first aperature having a generally horizontal axis and supported on one of said first cowl member and said first side of said propulsion unit, and a first resilient mounting member supported on the other of said first cowl member and said first side of said propulsion unit and received in said first aperature, second means for removably and resiliently mounting said second cowl member on said second side of said propulsion unit and including a second aperature having a generally horizontal axis and supported on one of said second cowl member and said second side of said propulsion unit, and a second resilient mounting member supported on the other of said second cowl member and said second side of said propulsion unit and received in said second aperature, said first and second means for mounting said cowl members including means for compressing said first resilient mounting member in said first aperature incident to receipt of said first mounting member in said first aperture and for compressing said second resilient mounting member in said second aperature incident to receipt of said second mounting member in said second aperture, and means for releasably connecting together said first and second cowl members to retain said first and second mounting members in said first and second aperatures.

28. An outboard motor as set forth in claim 27 wherein said power head has opposite first and second sides, wherein said first means includes means removably and resiliently mounting said first cowl member on said first side of said power head, and wherein said second means includes means removably and resiliently mounting said second cowl member on said second side of said power head.

29. An outboard motor as set forth in claim 27 wherein said drive shaft housing has opposite first and second sides, wherein said first means includes means removably and resiliently mounting said first cowl member on said first side of said drive shaft housing, and wherein said second means includes means removably and resiliently mounting said second cowl member on said second side of said drive shaft housing.

30. An outboard motor as set forth in claim 24 wherein said power head has opposite first and second sides, wherein said first means also includes means removably and resiliently mounting said first cowl member on said first side of said power head, and wherein said second means also includes means removably and resiliently mounting said second cowl member on said second side of said power head.

31. An outboard motor as set forth in claim 27 wherein said first aperature is in said first cowl member, wherein said first resilient mounting member is supported on said first side of said propulsion unit, wherein said second aperature is in said second cowl member, and wherein said second resilient mounting member is supported on said second side of said propulsion unit.

32. An outboard motor as set forth in claim 31 wherein said first means further includes a first mounting pin extending generally horizontally from said first side of said propulsion unit, wherein said first resilient mounting member is mounted on said first mounting pin, wherein said second means further includes a second mounting pin extending generally horizontally from said second side of said propulsion unit, and wherein said second resilient mounting member is mounted on said second mounting pin.

33. An outboard motor as set forth in claim 32 wherein said first and second resilient mounting members and said first and second aperatures are frustoconical.

* * * * *